US006632003B2

(12) United States Patent
Marquardt et al.

(10) Patent No.: US 6,632,003 B2
(45) Date of Patent: Oct. 14, 2003

(54) SIGNAL APPARATUS

(75) Inventors: Erich Marquardt, Rietheim-Weilheim (DE); Steffen Rudischhauser, Spaichingen (DE); Reinhard Mordau, Hausen o. V. (DE)

(73) Assignee: WERMA Signaltechnik GmbH & Co., Rietheim-Weilheim (DE)

( * ) Notice: Subject to any disclaimer, the term of this patent is extended or adjusted under 35 U.S.C. 154(b) by 0 days.

(21) Appl. No.: 09/833,060

(22) Filed: Apr. 12, 2001

(65) Prior Publication Data

US 2002/0006042 A1 Jan. 17, 2002

(30) Foreign Application Priority Data

Apr. 12, 2000 (DE) ..... 100 18 222
Aug. 3, 2000 (DE) ..... 100 38 559

(51) Int. Cl.[7] ..... F21V 29/00
(52) U.S. Cl. ..... 362/267; 362/226; 362/363

(58) Field of Search ..... 362/267, 436, 362/226, 363, 441, 383, 288, 268; 340/332; 116/202, 280, 137 R; 315/58

(56) References Cited

U.S. PATENT DOCUMENTS 4,290,092 A * 9/1981 Bull ..... 362/368
4,931,766 A * 6/1990 Bernard et al. ..... 340/332
5,295,054 A * 3/1994 Baader et al. ..... 362/267
5,821,695 A * 10/1998 Vilanilam et al. ..... 315/58
5,952,915 A * 9/1999 Marquardt et al. ..... 340/332

* cited by examiner

*Primary Examiner*—Sandra O'Shea
*Assistant Examiner*—Bao Truong
(74) *Attorney, Agent, or Firm*—Crowell & Moring LLP

(57) ABSTRACT

A signal apparatus is disclosed which permits flexible use of the individual signal apparatus components. According to the invention, a holder and a signal generator for the connection to the holder are provided. The signal generator includes a base housing made of plastic and penetrated by at least two contact elements, and the function elements of the signal apparatus.

16 Claims, 7 Drawing Sheets

SIGNAL APPARATUS

BACKGROUND AND SUMMARY OF THE INVENTION

The invention relates to a signal apparatus, particularly an optical signal apparatus such as from a signal lamp, or an acoustic signal.

As a rule, signal apparatuses, for example, for optical or acoustic signals on machines, systems, buildings or the like, are provided with a housing which has the required electrical connections and in which the necessary function parts are housed. According to the further development of the signal apparatus, a spherical cap is mounted on this housing.

Signal apparatuses of this type are, as a rule, conceived and used as a complete constructional unit, the individual constructional components being completely adapted to the use on the respective signal apparatus.

It is an object of the invention to suggest a signal apparatus which permits a more flexible use of the individual signal apparatus components.

Based on a signal apparatus of the initially mentioned type, this object is achieved by a signal apparatus characterized in that a holder and a signal generator for the connection to the holder are provided, the signal generator comprising a base housing made of a plastic material and penetrated by at least two contact elements, and function elements of the signal apparatus.

As a result of the measures indicated in the claims, advantageous embodiments and further developments of the invention can be obtained.

Correspondingly, a signal apparatus according to the invention is characterized in that a holder and a signal generator for the connection to the holder are provided, the signal generator comprising a base housing made of plastic and penetrated by at least two contact elements, and comprising the function elements of the signal apparatus.

In the case of such a signal apparatus, different signal generators can be used with one and the same holder, which signal generators differ according to the type of their function or according to their size. The holder has the purpose of implementing the mounting and the electrical connection at the application site.

In contrast, the signal generator is adapted with respect to the size and function to the application purpose of the signal apparatus and, when placed in the above-mentioned holder, is simultaneously fixed at the application site and electrically contacted.

As a result of this construction of a signal apparatus, the multiplicity of the parts is reduced, on the one hand, because the same holder can be used for a plurality of different signal apparatuses. On the other hand, the flexibility is improved since, as a result of the simple exchange of the signal generator, the type of the signal apparatus can be varied or defective operating components can be exchanged.

As a result of the construction of the base housing of the signal generator of a plastic material and thus of an insulating material, sufficient safety is provided with respect to current-carrying parts as well as concerning a good tightness with respect to dust and water.

The contact elements preferably penetrate a bottom plate of the base housing. As a result, the base can be designed such that it can be used in known standard holders, for example, for illumination devices, in which case, during the insertion into the corresponding holder, the required electrical contact is closed at the conventional contact points. In this case, the contact elements can be constructed, for example, as contact pins which establish not only the exterior contact but simultaneously project to the components to be contacted into the interior of the base.

In a preferred embodiment of the invention, the base of the signal generator is constructed as an adapter piece for differently shaped signal apparatuses which fits onto the holder according to the invention. Such an adapter piece permits, for example, the variation of the overall height or of the diameter of a signal apparatus without the requirement of changing the holder provided for fixing the signal apparatus and the electrical connection.

In a preferred embodiment of the invention, the contact elements are simultaneously provided with cutting and/or detent elements which are used for the fixation in the base of the signal generator. The cutting elements may be constructed, for example, in the form of sawtooth-shaped external toothings 90 on the contact pins which, when pressed in, cut into the base material and thus at least partially gear with the base plate, whereby, after the pressing-in, the contact elements are fixed. The detent elements, by means of which the contact elements are locked at the base, are also conceivable in a different embodiment.

Advantageously, the base of the signal generator is constructed such that electronic components are arranged in the base housing. Because of the insulating characteristic of the base housing, the components can be connected without any problem on the base housing itself. However, in a preferred embodiment, a printed circuit board is provided which is electrically connected with the contact elements. A base which is provided with electronic components in such a manner can be used as a complete signal generator for a plurality of various signal apparatus types. Particularly by means of the embodiment in which the electronic components are arranged on the printed circuit board, as a result of the exchange of the printed circuit board and a variable design of the remaining construction on the base housing, a large number of different signal apparatus applications can be implemented in this case.

The above-mentioned printed circuit board, which is connected with the electrical contact elements, for example, by means of a plug contact, can, in turn, be used for electrically contacting arbitrary additional function elements. Thus, for example, an LED-type printed circuit board can be fitted onto the first-mentioned printed circuit board, or connecting elements can be provided for contacting a buzzer. It is also conceivable to provide another mounting for function elements in the base housing which is controlled by means of the electronic components arranged on the printed circuit board or at an arbitrary point in the interior of the base housing.

In a special embodiment of the invention, additional fastening elements for other components are molded into the base housing of the signal generator. This can be achieved without any problem mainly because the base housing is made of a plastic material and facilitates the mounting of, for example, a printed circuit board or a spherical cap on the base housing.

In this case, all conceivable embodiments, such as a bayonet catch or a threaded piece, etc. can be used as the fastening element.

In a particularly advantageous embodiment, the fastening elements, for example, for fixing the printed circuit board or a spherical cap, are constructed as a detent element, so that a particularly simple and optionally detachable mounting of the corresponding component can be achieved.

When the printed circuit board is pressed into detent elements of this type, for example, in the case of a plug-type connection, a contacting as well as the fixing of the printed circuit board with respect to the base housing can be established simultaneously.

The above-mentioned spherical cap can carry out several functions, and can, for example, in the case of an optical signal apparatus, influence the radiation characteristic. Furthermore, the spherical cap can have a protective and insulating function. Thus, the interior of the signal generator, for example, is protected from dirt by means of such a spherical cap. The spherical cap also represents a touch guard because it can be constructed to be electrically as well as thermally insulating.

As required, this protection and insulating function of the spherical cap can be further improved by an additional sealing between the spherical cap and the base of the signal generator.

According to the design of the base of the signal generator, another spherical cap may also be provided which closes off the signal apparatus toward the outside and is connected with the holder. However, in a particularly advantageous embodiment, the same spherical cap is used for closing off the signal generator and simultaneously the signal apparatus as a whole.

In an embodiment of the invention, while using a signal generator with a spherical cap, for example, when the base housing is constructed as an adapter for various forms of spherical caps, the spherical cap is firmly connected with the base housing in a dust-tight and water-tight manner. A welded or glued connection, for example, can be used here. A sealing pressing-together could also be provided at this point in the case of corresponding materials. An additional sealing between the base and the spherical cap can be eliminated in this construction.

The safety and durability of the signal apparatus can be further improved in that a seal is provided between the holder and the signal generator. In this manner, the penetration of water or dust into the interior of the signal apparatus is effectively prevented also at the boundary between the holder and the signal generator, so that the signal apparatus can also be used under correspondingly contrary environmental conditions.

The holder is preferably also provided with a housing which is shaped in one piece of insulating material and has at least two contact elements. In addition to an advantageous manufacturing of the holder housing of a plastic material by means of corresponding shaping processes, this design of the holder is also advantageous with respect to safety aspects. On the one hand, such a holder housing can be constructed in a dust-tight and water-tight manner without any problem; on the other hand, as a result of the material, an electrical and thermal insulation function is carried out which, in particular, creates a touch guard. By means of the separately mounted contact elements, the electrical connection can be established to the contact elements of the signal generator.

In a particularly advantageous embodiment, self-locking cable clamps are provided for this purpose which are each provided with a contact element. The self-locking cable clamp facilitates the clamping-on of an electrical connecting cable at the application site. Such self-locking cable clamps are customary, for example, in household electronics for connecting cables. A cable end, preferably with a corresponding end piece, such as a multicore cable end, is fitted into such a cable clamp and is held there in a self-locking manner.

In that such cable clamps are advantageously equipped with contact elements, the entire holder of the signal apparatus according to the invention can be completed by the insertion of such cable clamps. With the insertion of the cable clamps, the contact elements for establishing the contact with the contact elements of the signal generator of the signal apparatus are then simultaneously mounted.

The contact elements of the holder are preferably constructed as contact springs which yield when the signal generator is fitted into the holder and ensure a reliable contacting as a result of their restoring force.

In a special embodiment of the invention, a receiving bore is provided in the holder and has two lateral slots. This receiving cylinder is used, on the one hand, for constructing the holder in the form of known illuminant holders, for example, with a bayonet catch or a screw cap. As a result of the lateral slots, it is possible to press the cable clamps provided with the contact elements into the holder housing, the contact elements projecting into the interior of the receiving cylinder. This facilitates the mounting of the contact elements.

As mentioned above, in the case of the signal apparatus according to the invention, the signal generator may have different function elements for the insertion into the holder. Thus, the signal generator may have various optical function elements. It may comprise, for example, LED-lamps or conventional lamps as illuminants. It may also be designed as a flash lamp. Furthermore, a further development of the signal generator, for example, for an acoustic signal apparatus is conceivable. It can, in this case, for example, be constructed as a buzzer, a multisound siren or a loudspeaker. A buzzer can be constructed in a known manner by the formation of a membrane in a spherical cap with a piezo disk as a vibration exciter. The electronic components of the signal generator can provide different controls of acoustic signals, for example, different pulse sequences, changes of intensity, etc. Furthermore, in the case of an acoustic signal apparatus, a speech synthesis or the like can also be provided.

In the case of the signal apparatus according to the invention, the function can just as well be used by a simple exchange of the signal generators, as, for example, the size, the color, etc.

An embodiment of the invention is illustrated in the drawing and will be explained in detail in the following by means of the figures.

DETAILED DESCRIPTION OF THE DRAWINGS

Figure 1:
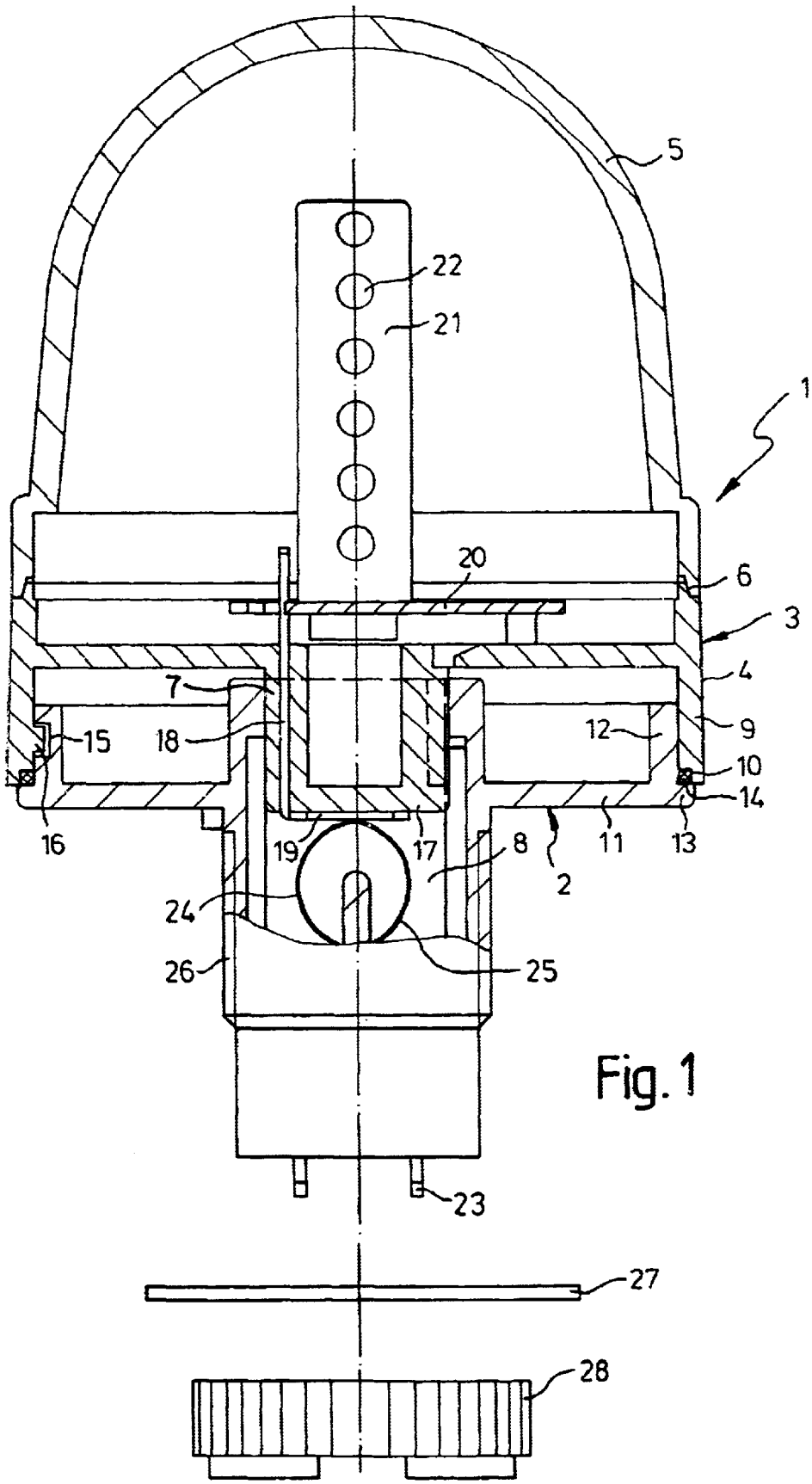
FIG. 1 is a sectional view of a signal apparatus according to the invention as an LED lamp with an adapter base.

With respect to the details, FIG. 1 illustrates a signal apparatus 1 which comprises a holder 2 and a signal generator 3. The signal generator 3 consists of an adapter base 4 which is connected with a spherical cap 5. At the connection point 6, the spherical cap is welded in a water-tight and dust-type manner to the adapter base 4.

On one side, the adapter base 4 comprises a connection piece 7 which is fitted into a receiving cylinder 8 of the holder 2. At the exterior edge, the adapter base 4 is provided with a collar 9 which has a ring shoulder 10 on the interior side. By means of a disk-type bottom part 11, the holder 2 extends to the collar 9 and has a ring projection 12 which fits into the interior of the collar 9. A hollow space for receiving a sealing ring 14 is obtained between the bottom part 11 and the ring shoulder 10 as a result of a small projecting length 13.

Further, the ring projection 12 comprises grooves 15 which, interacting with bayonet projections 16 on the collar 9, form a bayonet catch. Three grooves 15 offset by 120 degrees can, for example, be provided.

The adapter base 4 is penetrated on the bottom plate of the connection piece 7 by contact elements 18, of which only one is visible in the representation of FIG. 1. The contact element 18 is angled and has a contact surface 19 extending parallel to the bottom plate 17. On the top side, the contact element 18 is connected with a printed circuit board 20 which is fastened in the adapter base 4 by way of mounting elements which are not shown. An LED printed circuit 21 with various LEDs 22 is fitted onto the printed circuit board 20. For this purpose, a plug-type connection, which is not shown in detail, is provided on the printed circuit board 20.

The holder 2 comprises two connecting lugs 23 which are to be contacted by means of cable lugs with a power cable which is not shown in detail. The connecting lugs are connected with contact springs 24, 25 which contact the contact surfaces 19 of the contact elements 18, which contact surfaces 19 are situated behind one another in the representation according to FIG. 1.

On the exterior side of the receiving cylinder 8 of the adapter base 4, an external thread 26 is situated by means of which the signal apparatus 1 can be mounted in a bore of a mounting device, for example, of a machine housing. A washer 27 and a nut 28 are shown separately and are used for mounting the holder 2 in such a bore, for example, of a machine housing. In this case, the washer 27 seals off the bore, which is not shown in detail, in the mounting device toward the outside.

Figure 2:
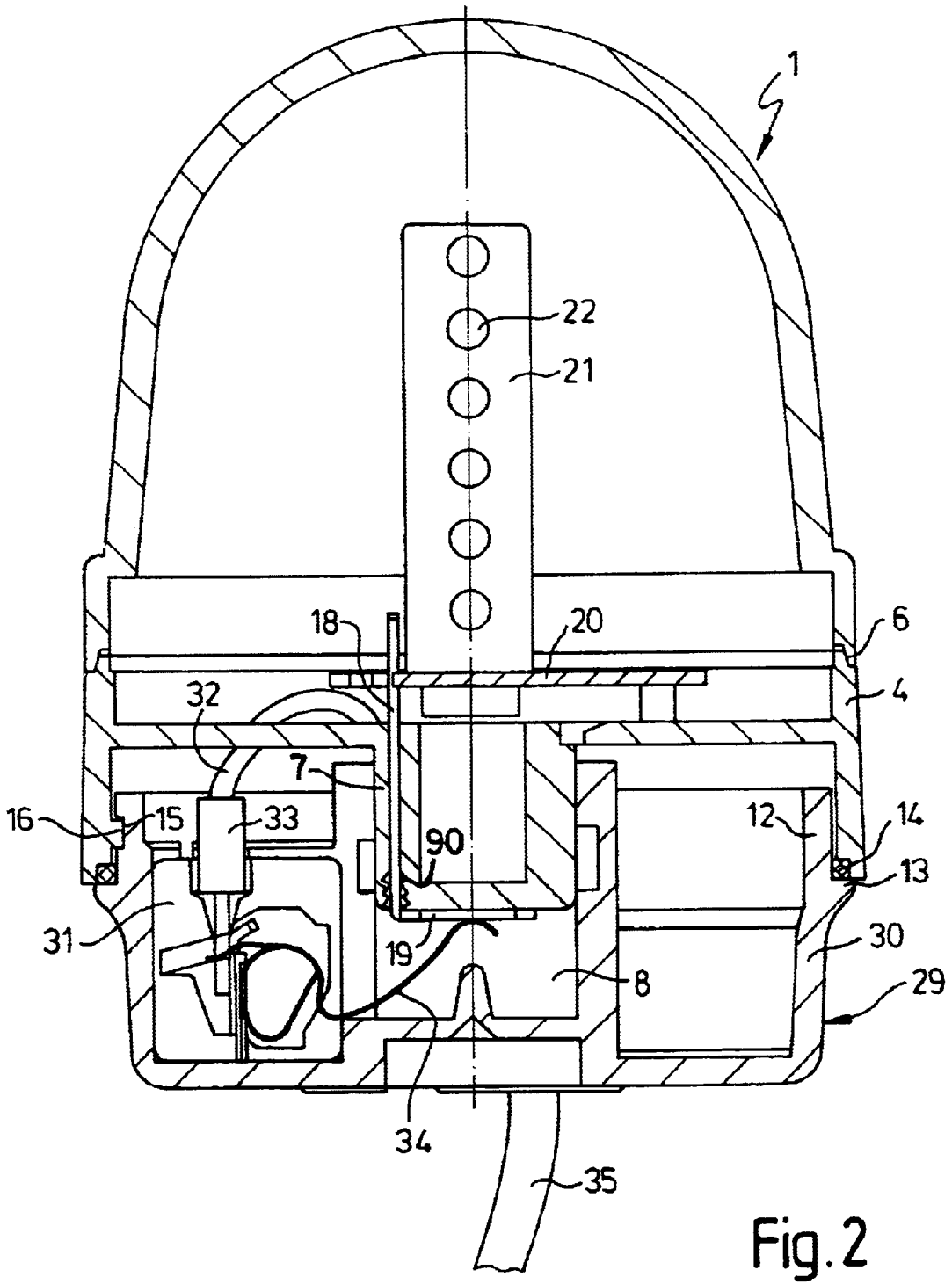
FIG. 2 is a sectional view of another embodiment of a signal apparatus with an adapter base in the form of an LED lamp.

FIG. 2 shows a corresponding signal apparatus 1 with a modified holder 29. Components which have the same function as in the embodiment according to FIG. 1 have the same reference numbers.

The holder 29 now comprises a pot-type base housing 30 in whose center a receiving cylinder 8 is again molded on. On the exterior side, the ring projection 12 as well as the projecting length 13 are again provided on the holder 29 so that the identical adapter base 4 according to the above-mentioned embodiment can be used in the case of the modified holder 29.

Beyond the geometrical shape of the base housing 30, the holder 29 differs with respect to the cable clamps 31 which, in a manner not shown in detail, hold in a self-clamping manner a power cable 32 which is provided with a multicore cable end 33. The cable clamp 31 is designed in a known manner with respect to the self-locking or clamping.

However, in addition, the cable clamp 31 is now equipped with a contact spring 34 which establishes the electrical connection from the multicore cable end 33 to the contact surface 19 of the contact element 18. As a result of the spring-elastic construction of the contact spring 34, the contact spring 34 can yield when the connection piece 7 is fitted into the receiving cylinder 8 and, because of its restoring force, can provide a reliable contacting.

A power cable 35, which comprises at least two cores, is guided in a manner which is not shown, for example, by means of conventional cable bushings, through an opening of the base housing 30 into the interior.

Figure 3:
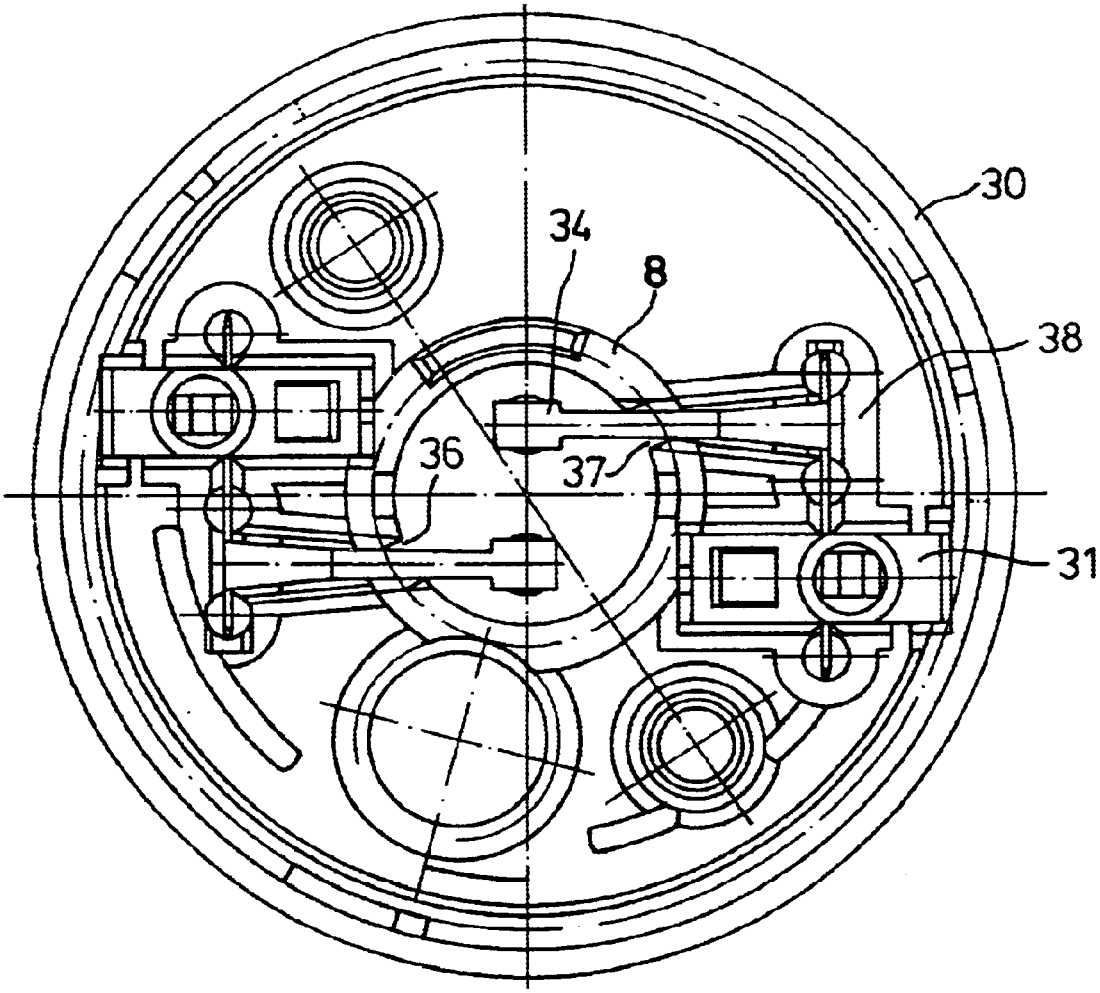
FIG. 3 is a top view of a holder of a signal apparatus according to FIG. 2.

FIG. 3 is a top view of the holder 29, in which particularly two slots 36, 37 are visible in the receiving cylinder 8, through which slots 36, 37 the contact springs 34 project into the receiving cylinder 8. The mounting of the contact springs 34 takes place with the insertion of the cable clamps 31, with which they are firmly connected, in two mountings 38 molded into the holder housing 30. Like the above described holder 2, the entire holder 29 according to this embodiment is molded in one piece of plastic material. The holder 29 is completely assembled with the pressing of the cable clamps 31 into the mountings 38.

Figure 4:
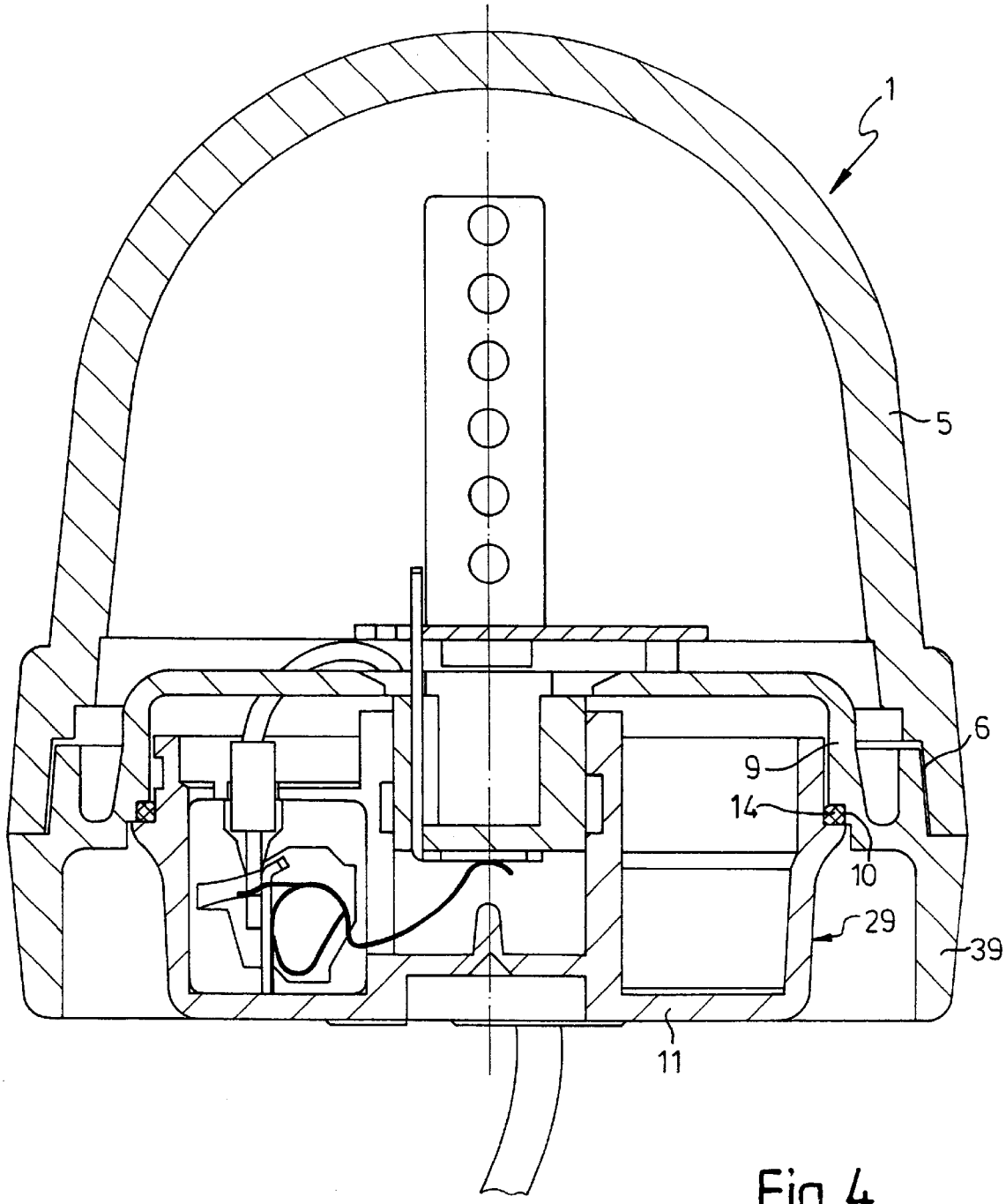
FIG. 4 is a sectional view of a signal apparatus according to FIG. 2, but with a larger circumference.

FIG. 4 shows a signal apparatus 1 with a diameter which is larger than in the embodiment according to FIG. 2. The holder 29 is identical with the holder 29 according to FIGS. 2 and 3. However, the adapter base 39 is now shaped such that its reaches around the holder 29 on the exterior side. As a result, the connection point 6 between the adapter base 39 and the spherical cap 5 is displaced toward the outside so that a larger spherical cap 5 can be fitted on. As previously, the collar 9 is molded into the adapter base 39 but is now molded in farther toward the inside and again has the ring shoulder 10 for receiving the sealing ring 14.

On the exterior side, the adapter base 39 is expanded to the height of the bottom part 11 so that, in the case of the signal apparatus 1, the holder 29, which is smaller than the adapter base 39, is covered, whereby the appearance of the signal apparatus 1 is improved. With the exception of the adapter base 39 and the correspondingly larger spherical cap 5, all components are present corresponding to the above-mentioned embodiment.

Figure 5:
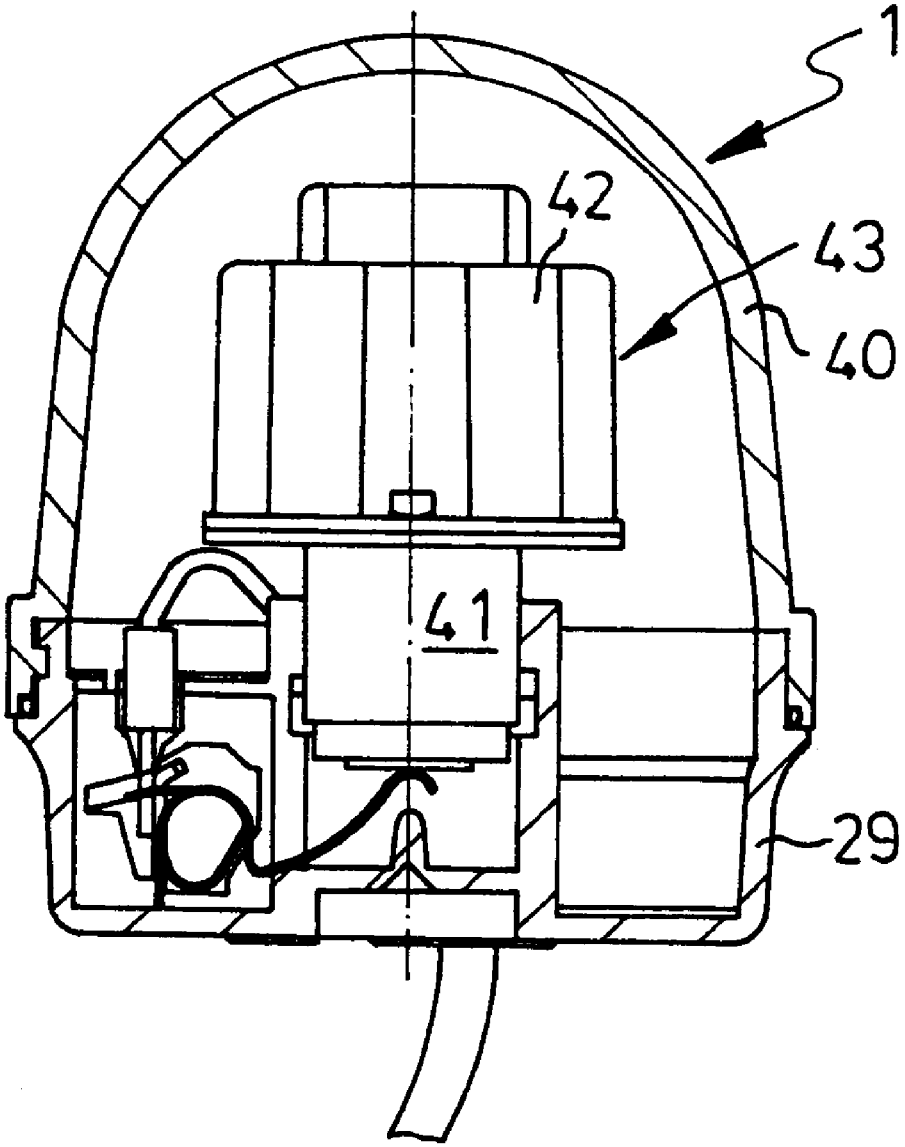
FIG. 5 is a sectional view of a signal apparatus having a closed LED illuminant as a signal generator and a second spherical cap.

FIG. 5 illustrates a signal apparatus 1 in which a spherical cap 40 is constructed such that it is to be connected directly with the holder 29 which corresponds to the above-described embodiment. However, as a signal generator 3 with contact elements according to the invention which, in this embodiment, are, however, not shown in detail, an illuminant 43 is provided which is closed in itself by means of another spherical cap 42. In its construction, this signal apparatus 1 corresponds to conventional signal apparatuses with an exterior housing and an insertable illuminant, the illuminant now forming the signal generator according to the invention. The illuminant 43 can be constructed, for example, as an LED illuminant and can be used similarly to a conventional lamp.

Figure 6:
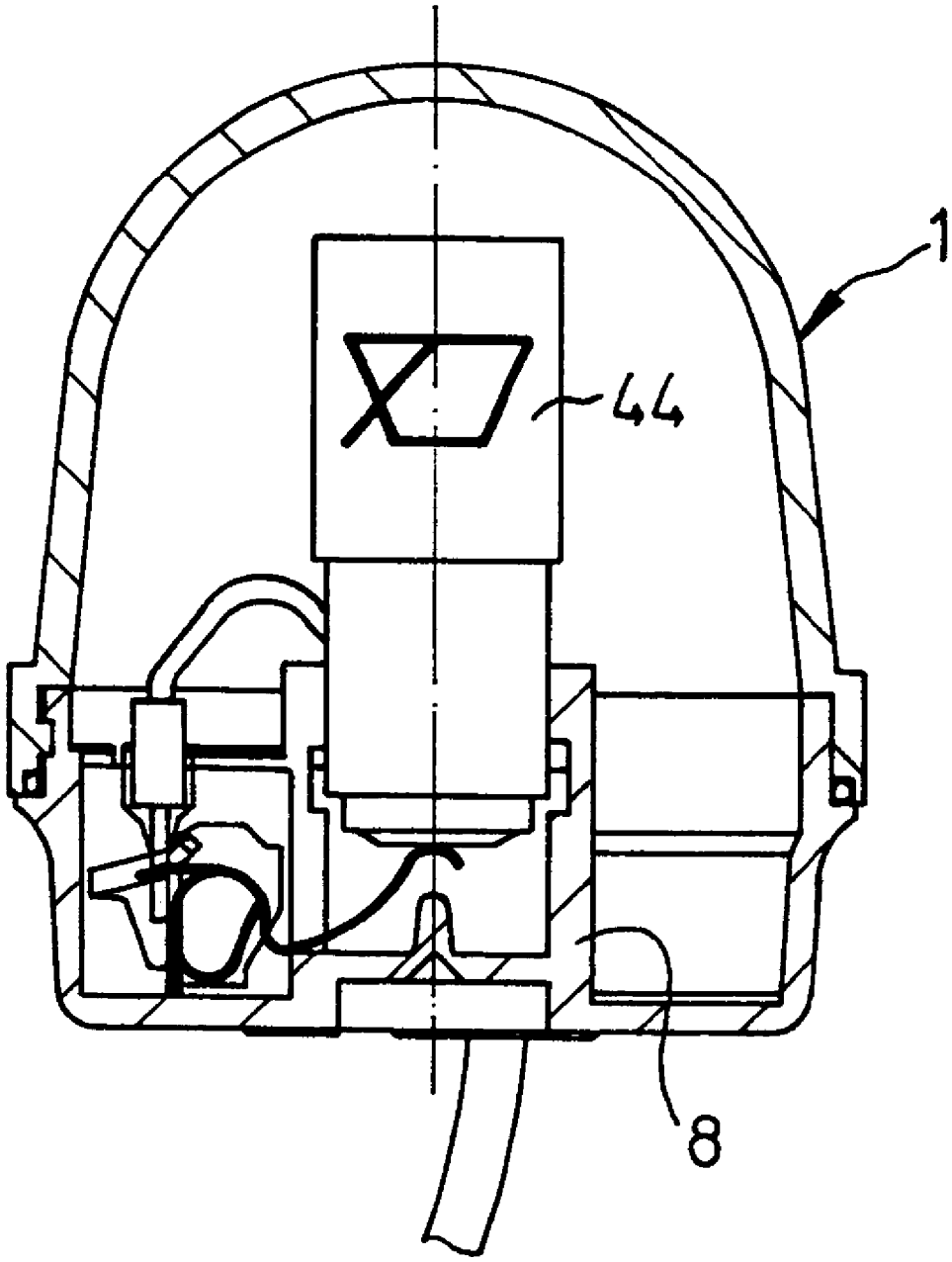
FIG. 6 is a sectional view of a signal apparatus with a lamp as a signal generator.

Correspondingly, FIG. 6 shows a usage possibility of a holder according to the invention in which, instead of the illuminant 43, a conventional lamp 44 is fitted into the receiving cylinder 8. The construction according to FIG. 6 shows that a signal lamp 1 according to the invention can be operatively constructed not only with signal generators according to the present invention but also with conventional lamps, which clearly increases the variety of application possibilities.

Figure 7:
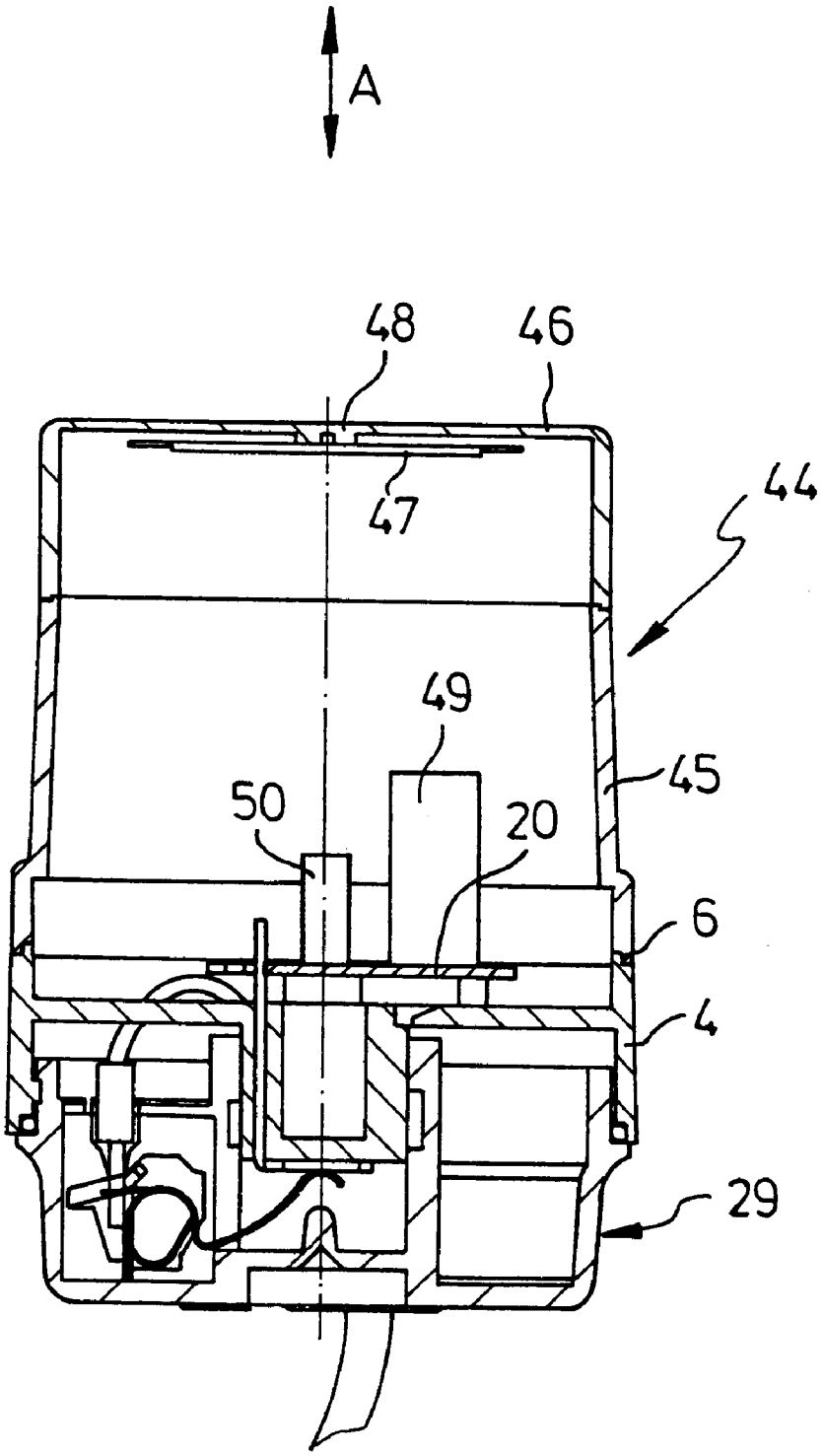
FIG. 7 is a sectional view of a signal apparatus according to the invention having an adapter base and a buzzer function.

FIG. 7 illustrates an acoustic signal apparatus 44. In this case, the holder 29 as well as the adapter base 4 corresponds to the embodiment described by means of FIGS. 2 and 3. Identical components therefore have the same reference numbers.

Deviating from the optical signal apparatus 1, the spherical cap 45 has an essentially cylindrical shape. The spherical cap 45 is again welded to the adapter base 4 at the connection point 6 in a water-tight and dust-tight manner. On the front side, the spherical cap 45 is provided with a membrane 46 which can swing particularly in the axial direction (double arrow A). A piezo disk 47 is centrally connected, for example, glued to the membrane 46, so that the membrane 46 can swing freely outside the mounting 48 for the piezo disk 47. The piezo disk 47 is energized by way of connection devices, such as cables, wires, etc. which are not shown in detail. The control circuit is illustrated by means of two electronic components 49, 50, which are outlined as examples, on the printed circuit board 20.

This embodiment illustrates how an acoustic signal apparatus can be produced with only slight changes while retaining identical components, such as the holder 29 and the adapter base 4, instead of an optical signal apparatus.

A signal apparatus according to the invention-can carry out multiple functions. It can be constructed as a buzzer, as a loudspeaker with voice reproduction, as a so-called multisound siren, etc. The required parameters, such as the pulse sequence, the intensity, the tonalities, etc. can easily be constructed to be adjustable by way of corresponding control elements, for example, on the printed circuit board 20. In particular, in this case, all standards for acoustic warning signals can be complied with.

The same advantages and the same variety can also be achieved in the area of the optical signal apparatuses, where the use of LEDs, of conventional lamps, of flash lamps, etc. can also be implemented in conjunction with corresponding control electronics.

The modular construction of signal apparatuses 1, 44 according to the invention permits not only a cost-effective manufacturing but also permits an adaptation to new desired application purposes without any problem. A change of functions in the case of a signal apparatus already mounted can be implemented in a particularly simple manner in that the signal generator 3 is exchanged while the holder 2, 29 is retained. Likewise, the repair can be carried out in a simple manner by exchanging the corresponding signal generator.

Table of Reference Numbers

| | |
|---|---|
| 1 | Signal apparatus |
| 2 | holder |
| 3 | signal generator |
| 4 | adapter base |
| 5 | spherical cap |
| 6 | connection point |
| 7 | connection piece |
| 8 | receiving cylinder |
| 9 | collar |
| 10 | ring shoulder |
| 11 | bottom part |
| 12 | ring projection |
| 13 | projecting length |
| 14 | sealing ring |
| 15 | grooves |
| 16 | bayonet projections |
| 17 | bottom plate |
| 18 | contact element |
| 19 | contact surface |
| 20 | printed circuit board |

-continued

Table of Reference Numbers

| | |
|---|---|
| 21 | LED printed circuit |
| 22 | LED |
| 23 | contact lug |
| 24 | contact spring |
| 25 | contact spring |
| 26 | external thread |
| 27 | washer |
| 28 | nut |
| 29 | holder |
| 30 | holder housing |
| 31 | cable clamp |
| 32 | power cable |
| 33 | multicore cable end |
| 34 | contact spring |
| 35 | power cable |
| 36 | slot |
| 37 | slot |
| 38 | mounting |
| 39 | adapter base |
| 40 | spherical cap |
| 41 | illuminant base |
| 42 | spherical cap |
| 43 | illuminant |
| 44 | signal apparatus |
| 45 | spherical cap |
| 46 | membrane |
| 47 | piezo disk |
| 48 | mounting |

What is claimed is:

1. A signal apparatus, comprising:

a holder having a receiving cylinder, the receiving cylinder having at least one lateral slot;

a signal generator connectable to the holder, the receiving cylinder receiving at least one part of the signal generator;

wherein the signal generator comprises a plastic material base housing having penetrations for at least two contact elements and signal apparatus functional elements; and wherein a further contact element of the holder is a contact spring and projects through the lateral slot into an interior of the receiving cylinder.

2. The signal apparatus according to claim 1, wherein the base housing includes a bottom plate, said at least two contact elements penetrating the bottom plate.

3. The signal apparatus according to claim 1, wherein the base housing of the signal generator is constructed as an adapter piece for differently shaped signal apparatuses, which adapter piece fits onto the holder.

4. The signal apparatus according to claim 1, further comprising at least one of cutting and detent elements operatively arranged to fix the at least two contact elements in the base housing.

5. The signal apparatus according to claim 1, further comprising electronic components arranged in the base housing.

6. The signal apparatus according to claim 1, further comprising a printed circuit board which is connected with the at least two contact elements.

7. The signal apparatus according to claim 1, further comprising fastening elements for additional components, said fastening elements being molded into the base housing of the signal generator.

8. The signal apparatus according to claim 7, wherein the fastening elements are constructed as detent elements.

9. The signal apparatus according to claim 1, further comprising a spherical cap provided for the signal generator.

10. The signal apparatus according to claim 9, wherein a seal is provided between the spherical cap and the signal generator.

11. The signal apparatus according to claim 9, wherein the spherical cap is firmly connected in a dust-tight and water-tight manner with the signal generator.

12. The signal apparatus according to claim 1, wherein a seal is provided between the holder and the signal generator.

13. The signal apparatus according to claim 1, wherein the holder comprises a holder housing which is molded of an insulated material and has at least two further contact springs.

14. The signal apparatus according to claim 13, wherein at least two self-locking cable clamps are provided, each being equipped with a respective one of the further contact springs for contacting the signal generator.

15. The signal apparatus according to claim 1, wherein the signal generator comprises at least one of an illuminant and a sound generator.

16. The signal apparatus according to claim 1, wherein the contact spring is operatively arranged in the interior of the receiving cylinder to engage the signal generator when the signal generator is connected to the holder.

* * * * *